United States Patent [19]

Turcotte et al.

[11] Patent Number: 5,062,987

[45] Date of Patent: Nov. 5, 1991

[54] COOLING SYSTEM CLEANING SOLUTIONS

[75] Inventors: David E. Turcotte; Daniel E. Coker, both of Woodhaven, Mich.

[73] Assignee: BASF Corporation, Parsippany, N.J.

[21] Appl. No.: 594,907

[22] Filed: Oct. 9, 1990

[51] Int. Cl.[5] ..... C11D 3/00; C11D 3/60

[52] U.S. Cl. ..... 252/156; 252/82; 252/180; 252/73; 252/87; 252/78.3; 204/181.2

[58] Field of Search ..... 252/82, 156, 180, 73, 252/87, 78.3; 204/181.2

[56] References Cited

U.S. PATENT DOCUMENTS

| | | | |
|---|---|---|---|
| 4,000,053 | 12/1976 | Kimura | 204/181.2 |
| 4,466,896 | 8/1984 | Darden | 252/78.3 |
| 4,469,615 | 9/1984 | Tsuruoka | 252/180 |
| 4,540,443 | 9/1985 | Barber | 252/87 |
| 4,707,286 | 11/1987 | Carr | 252/180 |

*Primary Examiner*—Paul Lieberman
*Assistant Examiner*—Kevin D. McCarthy

[57] ABSTRACT

Cooling system cleaning solutions containing an EDTA salt, sorbitol, and a soluble nitrate salt are effective in removing scale, corrosion, and solder bloom from cooling systems without blackening aluminum, and can be formulated into concentrates having enhanced storage stability.

17 Claims, No Drawings

COOLING SYSTEM CLEANING SOLUTIONS

BACKGROUND OF THE INVENTION

Field of the Invention

The subject invention pertains to cooling system cleaning solutions. More particularly, the subject invention pertains to storage stable cleaning solutions useful for removing various deposits from cooling systems utilized in the transportation industries.

Today in the transportation industry, cooling systems provide cooling for internal combustion engines contain a number of diverse materials in order to maximize cooling efficiency. At the same time, modern cooling systems minimize weight in order to promote fuel efficiency. Radiators, water pumps, impellers and housings of aluminum have become increasingly common, however, traditional materials, particularly cast iron, steel, brass, and copper continue to be used as well.

The extreme conditions in which these materials function are ideal for the formation of a variety of corrosion products such as metal oxides, hydroxides, and carbonates, as well as for the deposition of scale, particularly when "hard" water, i.e. water containing appreciable quantities of magnesium, and/or calcium ions are used. Finally, high lead content solders used to join together cooling system components are subject to the development of solder bloom, a high volume corrosion product.

These various deposits when created, coat the surfaces of cooling system components or clog their cooling passages, particularly in radiators. To remove these deposits, cleaning solutions are commonly used. However, these cleaning systems must perform their cleaning function, often in highly alkaline environments, without, at the same time, corroding the metals of which the cooling system is constructed. Furthermore, the cleaning solutions must be storage stable in order to be successfully commercialized.

U.S. Pat. No. 2,802,733, teaches a cleaning solution containing ethylenediamine tetraacetic acid (EDTA), sodium tripolyphosphate, sodium hydrogensulfite, and mixed oleic acid esters of polyoxyethylene glycols. In U.S. Pat. No. 3,419,501 is disclosed a cleaning solution containing EDTA, a nitrate salt, and an alkali metal silicate. U.S. Pat. No. 3,492,238 discloses a cleaning solution consisting of citric acid, sodium phosphate, sodium hydroxyethyl glycine, and sufficient water to maintain the pH between 6 and 7. In U.S. Pat. No. 4,540,443 is disclosed a cleaning solution effective for removing solder bloom, containing a salt of EDTA, a salt of citric acid, and a soluble salt of nitric acid, optionally containing also an aluminum corrosion inhibitor.

These prior cleaning solutions have had the drawbacks of introducing undesirable contaminants, for example phosphates, into the environment; the ability to remove scale but not solder bloom; or the inability of maintaining hardness ions such as calcium in solution at high pH levels. Many commercial cleaners cause darkening and/or corrosion of aluminum, while others may have limited shelf life. It would be desirable to prepare a cleaning solution for cooling systems which is effective in removing all common manner of scale and corrosion, in removing solder bloom, in maintaining hardness ions in solution even in highly alkaline environments, and which does not utilize phosphates in its composition. Most desirably, such a cleaning solution concentrate should be storage stable over extended periods.

OBJECTS OF THE INVENTION

It has now been surprisingly discovered that storage stable cleaning solutions for cooling systems may be prepared which are effective in removing scale, corrosion and oxidation products, and solder bloom without causing blackening or corrosion of the metal surfaces. Moreover, these compositions are effective in maintaining hardness ions such as calcium, aluminum, and iron in solution in the pH 9–14 range.

DESCRIPTION OF THE PREFERRED EMBODIMENTS

These and other objects have been achieved through the use of cleaning solutions comprising sorbitol, EDTA salts, sodium or ammonium nitrate, and optionally, nitric acid and/or preferably a corrosion inhibitor. This composition is preferably prepared as a concentrate and then diluted for use. Ethylene glycol is used in preparing the concentrate in order to render the concentrate storage stable for extended periods.

The EDTA salts suitable for use in the subject invention include the common alkali metal and ammonium salts of EDTA. The sodium salts are preferred, for example the disodium and tetrasodium salts. The tetrasodium salt is preferred.

A soluble nitrate salt, preferably an ammonium or alkali metal salt is used to supply nitrate to the composition. Sodium nitrate is preferred, however other equivalent methods of supplying nitrate ions may also be used. For example, the pH of the total composition may be adjusted by addition of nitric acid which also has the advantage of supplying nitrate ions. The reaction of nitric acid and basic salts contained in the composition will result in liberation of free carboxylic acid and formation of nitrate salts.

Preferred cleaning solutions within the scope of the subject invention also include a corrosion inhibitor, particularly an inhibitor which prevents corrosion of aluminum. Such corrosion inhibitors are well known to those skilled in the art, for example alkali metal silicates, siliconates, and silicone-silicate mixtures are useful corrosion inhibitors for aluminum. Especially preferred is a stabilized silicate/silicone of the type disclosed by U.S. Pat. Nos. 4,370,255, 4,362,644, and 4,354,002 which are herein incorporated by reference. For corrosion protection on copper and brass, numerous derivatives are known commonly to those skilled in the art. Preferred are benzotriazole and tolyltriazole. Most preferred is tolytriazole as the sodium salt.

Also useful in the compositions of the subject invention is a mineral acid. The mineral acid may be used to obtain a favorable pH range, preferably from 7 to 14, more preferably from 9 to 11, or most preferably about 10.3. The mineral acid may be useful in supplying nitrate to the composition when the mineral acid is nitric acid, but primarily is useful in preventing blackening and dissolution of aluminum through pH adjustment, for which the pH 9–11 range is preferred.

The cleaning solution concentrates of the subject invention preferably contain, based on the weight of the concentrate, from 1.0 to about 30.0 percent, preferably from !.0 to about 10.0 percent, and most preferably about 5.0 percent EDTA salt calculated on the basis of the tetrasodium salt; from 1.0 to about 50 percent, preferably from 1.5 to about 30 percent, and most preferably about 20 percent sorbitol; from 0.5 to about 8.0 percent, preferably from 1.0 to about 5.0 percent, and most preferably about 3.0 percent soluble nitrate salt calculated on the basis of sodium nitrate; from 1 to about 15, preferably from about 5 to 12, and most preferably about 10 percent of a silicon containing corrosion inhibitor, preferably a stabilized silicone/silicate inhibitor; and from 10 to about 50 percent, preferably from 20 to about 40 percent, and most preferably about 32 percent of a glycol, for example ethylene glycol, propylene glycol, diethylene glycol, or dipropylene glycol, and mixtures thereof. The balance of the composition is water, optionally containing low molecular weight alcohols such as methanol, ethanol, isopropanol, and the like. In the remainder of the specification and in the claims, this balance of the composition will be termed the "water miscible diluent." Preferably, the water miscible diluent is water or mixtures of water and lower alkanols.

When the composition contains a mineral acid, the acid is preferably present in an amount, based again on the total solution, of from 0.5 to about 8.0 weight percent calculated on the basis of 35 weight percent nitric acid. Preferably, the composition contains about 4.0 weight percent of 35 weight percent nitric acid.

The composition may optionally contain other additional corrosion inhibitors, inert ingredients, surfactants of the nonfoaming type, polyoxyethylene glycols, biocides, fungicides, and so forth. Also useful are dyes, particularly the fluorescent dyes such as the alizarine green and uranine yellow dyes.

The cleaning solution of the subject invention has thus far been described in terms of a concentrate. The use of such concentrates allows for economical packaging and shipping, and generally are diluted with water or mixtures of water and commercial antifreeze or ethylene glycol for use. The ratio of dilution may vary, but is typically 1:20. It is possible, of course, to prepare concentrates which are more dilute than the preferred concentrates of the subject invention. For example, a two-fold "diluted" concentrate would contain approximately half the weight percentage compositional ranges of the preferred concentrates, and correspondingly more water. If the concentrate is diluted enough, it may be possible to further reduce the glycol content from its proportional value.

The term "storage stability" as used herein refers to the ability of the concentrate formulation to avoid precipitation and/or gelling at typical storage and shipment temperatures. Storage stability is assessed visually by observing concentrates stored at various temperatures for varying lengths of time. It has been found, for example, that a glycol, preferably ethylene glycol must be present in the preferred concentrates, or gelation and/or precipitation may occur. If the concentrate is sold as a diluted concentrate, however, less ethylene glycol is expected to be necessary, and with certain formulations may be eliminated altogether.

EXAMPLE 1

A cleaning concentrate was prepared at pH 10.3 from 5.0 parts tetrasodium EDTA, 20.0 parts sorbitol, 3.0 parts sodium nitrate, sufficient nitric acid to adjust the pH to 10.3, 10.0 parts of stabilized silicone-silicate corrosion inhibitor, 32.0 parts ethylene glycol, and sufficient water to make 100.0 parts. It is possible to add water to obtain lower concentrations. The cleaning solution diluted approximately 1:19 with water, was circulated at 20 gallons/minute at 190 F and tested against new metal coupons of copper, solder, brass, mild steel, cast iron, and aluminum in a modified ASTM D2570 test, and on coupons having various types of scale, corrosion, and solder bloom. Tests on the new metal coupons showed no significant metal loss. The solution also gave similar results in a more difficult modified ASTM D 1384 glassware corrosion test on new metal coupons.

The solution was generally effective in removing corrosion and oxidation products on all oxidized and corroded coupons based on the modified ASTM D2570 test. The solution was particularly efficient in removing solder bloom. Cast iron and steel coupons having moderate to heavy amounts of general and crevice corrosion and a moderate amount of rust, when treated, showed a small decrease in general. Copper and brass coupons having moderate to heavy amounts of corrosion were treated and showed substantial decrease in corrosion. A portion of the copper coupon was even judged to be shiny following treatment. Visual examination of all corroded metal coupon samples showed no detrimental effects, such as blackening or pitting, as a result of the simulated cleaning experiment.

We claim:

1. An alkaline, storage stable cooling system cleaning concentrate composition having a pH of from 9 to 11, comprising in weight percent based on the total weight of the concentrate, a. from 1 to about 30 percent of an EDTA salt selected from the group consisting of the alkali metal and ammonium salts of EDTA;
b. from 1 to about 50 percent of sorbitol;
c. from 0.5 to about 8 percent of a soluble nitrate salt;
d. from 1 to about 15 percent of a silicon containing aluminum corrosion inhibitor selected from the group consisting of alkali metal silicates, siliconates and silicone-silicate mixtures;
e. an amount of a glycol which is effective to render the composition storage stable; and
f. from 0.5 to about 8 percent of a mineral acid.

2. The composition of claim 1 further comprising a water miscible diluent.

3. The composition of claim 2 wherein said mineral acid is 35 weight percent nitric acid.

4. The composition of claim 1 wherein said corrosion inhibitor (d) is a stabilized silicone/silicate corrosion inhibitor.

5. The composition of claim 2 wherein said corrosion inhibitor (d) is a stabilized silicone/silicate corrosion inhibitor.

6. The composition of claim 3 wherein said corrosion inhibitor (d) is a stabilized silicone/silicate corrosion inhibitor.

7. An alkaline, storage stable cooling system cleaning concentrate composition as claimed in claim 2, comprising, in weight percent based on the total weight of the concentrate, a. from 1 to about 10 percent of an EDTA salt;
b. from 1.5 to about 30 percent sorbitol;
c. from 1.5 to about 5 percent of a soluble nitrate salt;
d. from 5 to about 12 percent of a stabilized silicone/-silicate corrosion inhibitor; and
e. from 10 to about 50 percent of a glycol.

8. The composition of claim 7 wherein said glycol is ethylene glycol.

9. The composition of claim 7, wherein said mineral acid is nitric acid.

10. An alkaline, storage stable cooling system cleaning composition comprising an EDTA salt in an amount of about 5 percent; sorbitol in an amount of about 20 percent; sodium nitrate present in an amount of about 3 percent; a stabilized silicone/silicate corrosion inhibitor present in an amount of about 10 percent; and ethylene glycol present in an amount of about 32 percent; the balance of the composition comprising essentially water.

11. The composition of claim 1 further comprising a copper and brass corrosion inhibitor.

12. The composition of claim 11, further comprising a copper and brass corrosion inhibitor selected from the group consisting of benzotriazole, tolyltriazole, their salts, and mixtures thereof.

13. A process for the cleaning of a coolant system comprising employing as the cleaning solution the cleaning solution of claim 1.

14. The composition of claim 1, wherein said pH is about 10.3.

15. The composition of claim 7, wherein said pH is about 10.3.

16. The composition of claim 10, further comprising sufficient nitric acid to render the pH of said composition to be in the range of 9 to 11.

17. The composition of claim 16, wherein said pH of said composition is about 10.3.

* * * * *